US007858893B1

(12) United States Patent
Haff et al.

(10) Patent No.: US 7,858,893 B1
(45) Date of Patent: Dec. 28, 2010

(54) SORTING OF AGRICULTURAL PROCESS STREAMS

(75) Inventors: Ronald P. Haff, Davis, CA (US); Eric S. Jackson, Oakland, CA (US)

(73) Assignee: The United States of America as represented by the Secretary of Agriculture, Washington, DC (US)

( * ) Notice: Subject to any disclaimer, the term of this patent is extended or adjusted under 35 U.S.C. 154(b) by 18 days.

(21) Appl. No.: 11/940,166

(22) Filed: Nov. 14, 2007

(51) Int. Cl.
*B07C 5/00* (2006.01)

(52) U.S. Cl. ..... 209/577; 209/576

(58) Field of Classification Search ..... 209/576, 209/77

See application file for complete search history.

(56) References Cited

U.S. PATENT DOCUMENTS 4,170,306 A * 10/1979 Marshall et al. ..... 209/549
4,454,029 A * 6/1984 Codding ..... 209/581
4,513,868 A * 4/1985 Culling et al. ..... 209/581
4,697,709 A * 10/1987 Codding ..... 209/549
5,111,926 A * 5/1992 Long ..... 193/46
5,603,413 A * 2/1997 Mitchum, Jr. ..... 209/580
5,631,460 A * 5/1997 Gray et al. ..... 250/226
6,252,188 B1 * 6/2001 Zapata et al. ..... 209/577

OTHER PUBLICATIONS

Haff, R.P., and T. Pearson, "Spectral Band Selection for Optical Sorting of Pistachio Nut Defects," American Society of Agricultural and Biological Engineers (2006) 49(4):1105-1113.

Bee and Honeywood, "Optical Sorting Systems" In:Detecting foreign bodies in food (2004) Chapter 6 pp. 86-118 Woodhead Publishing Limited—Cambridge England.

* cited by examiner

*Primary Examiner*—Terrell H Matthews
(74) *Attorney, Agent, or Firm*—Elizabeth R. Sampson; John D. Fado

(57) ABSTRACT

The present invention relates to an apparatus for automated sorting of objects comprising a population, and for methods of sorting using same.

10 Claims, 5 Drawing Sheets

SORTING OF AGRICULTURAL PROCESS STREAMS

FIELD OF THE INVENTION

The invention relates to an apparatus for automated sorting of objects comprising agricultural process streams and for methods of sorting using same.

BACKGROUND OF THE INVENTION

Optical sorters are routinely used in processing plants to remove contaminants and/or defects from a variety of agricultural commodities e.g., tree nuts, peanuts, fruits, vegetables, and grain. Modem commercially available sorting equipment typically measures reflectance from a sample at two wavelengths, either in the visible, or near infrared (NIR) regions of the electromagnetic spectrum. The outputs of photodiode based detectors are input into a computer, or the equivalent i.e., any microprocessor based device, either for mapping and algorithm parameterization in the training process, or for classification during sorting (see e.g., Bee and Honeywood, (2004) In "Detecting foreign bodies in food", Chapter 6. Edited by M. Edwards).

Most modern commercially available sorting devices are not designed for optimal sorting of any particular defect or commodity, but instead are designed to be adaptable to many different sorting tasks through training (see e.g., Haff and Pearson, (2006) *Trans. ASABE* 49(4): 1105-1113). Thus, the typical computer based sorting equipment is sophisticated, but is often unnecessarily complex for simple sorting tasks. Moreover, modem computer based sorting equipment is expensive. Indeed, new units typically cost upward of $100,000.

Unfortunately, despite the sophistication and cost, computer/micro-processor based sorting devices are often unable to achieve the quality standards mandated by consumers or regulatory agencies for a product. Thus, manual inspection of the product is also frequently required. The high cost of manual labor and the expensive sorting equipment burdens agricultural producers with high costs. Naturally, the high cost of producing a product is passed on to consumers, and high cost may ultimately limit sales.

Clearly then, commodity producers as well as consumers stand to benefit from quality, well sorted product at lower prices. Thus, what is needed in the art is an alternative to the expensive computer/micro-processor based sorting equipment currently in use. Fortunately, as will be clear from the following disclosure, the present invention provides for this and other needs.

SUMMARY OF THE INVENTION

In one aspect, the invention provides an apparatus for sorting objects comprising a population to be sorted into at least a first class and a second class. The apparatus comprises: (i) a product feeding means, (ii) a light source, (iii) a sensing area (iv) a light conducting means, (iv) an optical bandpass filter and a photodiode which form an optical bandpass filter-photodiode combination, (vi) a decision circuit, and (vii) a diversion means, and the optical bandpass filter transmits light to the photodiode in a band of wavelengths centered at a desired wavelength, and the photodiode converts the light transmitted through the optical bandpass filter to an electric current, thereby generating a signal related to the desired wavelength that is input to the decision circuit, which is an electronic circuit that does not require a microprocessor to evaluate signals and make decisions.

In one exemplary embodiment, the population to be sorted comprises an agricultural process stream. In another exemplary embodiment, the agricultural process stream comprises a population of tree nuts. In another exemplary embodiment, the population of tree nuts is a population of pistachio nuts. In another exemplary embodiment, the population of pistachio nuts comprises in-shell nuts and kernels.

In one exemplary embodiment, the product feeding means is a member selected from the group consisting of a slide, a conveyor belt, and a rotating drum, and wherein, the product feeding means delivers the objects comprising the population to a sensing area in single file.

In one exemplary embodiment, the light source provides light at a wavelength that is a member selected from the group consisting of light wavelengths in the visible region of the electromagnetic spectrum and light wavelengths in the near infrared region of the electromagnetic spectrum. In another exemplary embodiment, the light wavelength is a member selected from the group consisting of light wavelengths in the red region of the visible electromagnetic spectrum.

In one exemplary embodiment, the decision circuit comprises a signal conditioning means, a comparing means, and a switching means, and the comparing means compares the signal output from the signal conditioning means to a threshold value. In another exemplary embodiment, the comparing means comprises a comparator.

In one exemplary embodiment, the diversion means is a member selected from the group consisting of an air burst, a mechanical arm or lever, a water jet, an air powered actuator, and a hydraulic powered actuator.

In another aspect, the invention provides an apparatus for sorting objects comprising a population to be sorted into at least a first class and a second class. The apparatus comprises (i) a product feeding means, (ii) a light source, (iii) a sensing area (iv) at least a first and at least a second light conducting means, (iv) at least a first optical bandpass filter and a first photodiode which form a first optical bandpass filter-photodiode combination and at least a second optical bandpass filter and a second photodiode which form a second optical bandpass filter-photodiode combination, (vi) a decision circuit, and (vii) a diversion means, and the at least first optical bandpass filter transmits light to the at least first photodiode in a band of wavelengths centered at a first desired wavelength, and the at least second optical bandpass filter transmits light to the at least second photodiode in a band of wavelengths centered at a second desired wavelength, and the at least first photodiode converts the light transmitted through the first optical bandpass filter to an electric current, thereby generating a signal related to the first desired wavelength that is input to the decision circuit, and the at least second photodiode converts the light transmitted through the at least second optical bandpass filter to an electric current, thereby generating a signal related to the second desired wavelength that is input to the decision circuit, which is an electronic circuit that does not require a microprocessor to evaluate signals and make decisions.

In one exemplary embodiment, the light source provides light at a wavelength that is a member selected from the group consisting of light wavelengths in the visible region of the electromagnetic spectrum and light wavelengths in the near infrared region of the electromagnetic spectrum.

In another exemplary embodiment, the at least first optical bandpass filter-photodiode combination and the at least second optical bandpass filter-photodiode combination are to responsive different wavelengths of light.

In another exemplary embodiment, the decision circuit comprises: at least a first signal conditioning means, and at least a second signal conditioning means, an amplifier, a comparing means, and a switching means, and the comparing means compares the signal output from the amplifier to a threshold value. In one exemplary embodiment, the comparing means comprises a comparator. In one exemplary embodiment, the amplifier is a summing amplifier. In another exemplary embodiment, the amplifier is a difference amplifier.

In another exemplary embodiment, the diversion means is a member selected from the group consisting of an air burst, a mechanical arm or lever, a water jet, an air powered actuator, and a hydraulic powered actuator.

In another exemplary embodiment, the apparatus further comprises at least a third optical bandpass filter-photodiode combination, and wherein the decision circuit comprises: at least a first, at least a second and at least a third signal conditioning means, an amplifier, a comparing means, and a switching means.

In another aspect, the invention provides an apparatus for sorting a population of pistachio nuts into at least first class and a second class. The apparatus comprises (i) a product feeding means; (ii) a light source; (iii) a sensing area, (iv) a light conducting means; (v) an optical bandpass filter and a photodiode which form an optical bandpass filter-photodiode combination, wherein the optical bandpass filter transmits light to the photodiode in a band of wavelengths centered at 670 nm; (vi) a decision circuit, and (vii) a diversion means, and the photodiode converts the light transmitted through the optical bandpass filter to an electric current, thereby generating a signal related to 670 nm wavelength that is input to the decision circuit, and the decision circuit is an electronic circuit that does not require a microprocessor to evaluate signals and make decisions.

In one exemplary embodiment, the decision circuit comprises: a signal conditioning means, a comparing means, and a switching means, and the comparing means compares the signal output from the signal conditioning means to a threshold value.

In another exemplary embodiment, the comparing means comprises a comparator.

In another exemplary embodiment, the diversion means is a member selected from the group consisting of an air burst, a mechanical arm or lever, a water jet, an air powered actuator, and a hydraulic powered actuator.

In another exemplary embodiment, the population of pistachio nuts comprises in-shell nuts and kernels.

In another exemplary embodiment, the invention provides a method of sorting object types comprising a population to be sorted into one of at least a first class and a second class. The method comprises: (1) determining a percent reflectance from each object type comprising the population to be sorted at light wavelengths across a spectrum of light wavelengths comprising wavelengths from about 400 nm to about 1700 nm, (2) calculating the difference in percent reflectance between each object type comprising the population to be sorted at light wavelengths across the spectrum of light wavelengths from about 400 nm to about 1700 nm, (3) selecting a light wavelength wherein the difference in percent reflectance between each object type comprising the population is greatest, thereby discovering a desired wavelength, (4) loading a population to be sorted which comprises the object types onto an apparatus for sorting objects, wherein the apparatus comprises: (i) a product feeding means, (ii) a light source, (iii) a sensing area, (iv) a light conducting means, (v) an optical bandpass filter centered at the desired wavelength and a photodiode which form an optical bandpass filter-photodiode combination centered at the desired wavelength, (vi) a decision circuit, and (vii) a diversion means. Wherein the optical bandpass filter transmits light to the photodiode in a band of wavelengths centered at the desired wavelength, and wherein the photodiode converts the light transmitted through the optical bandpass filter to an electric current, thereby generating a signal related to the desired wavelength that is input to the decision circuit, and wherein the decision circuit is an electronic circuit that does not require a microprocessor to evaluate signals and make decisions, (5) setting a threshold value for activation of the diversion means by the decision circuit, and (6) activating the apparatus for sorting objects, thereby sorting object types comprising a population to be sorted into one of at least a first class and a second class.

Other features, objects, advantages and embodiments of the invention will be apparent from the detailed description which follows.

DETAILED DESCRIPTION OF THE INVENTION

Definitions

Figure 1A:
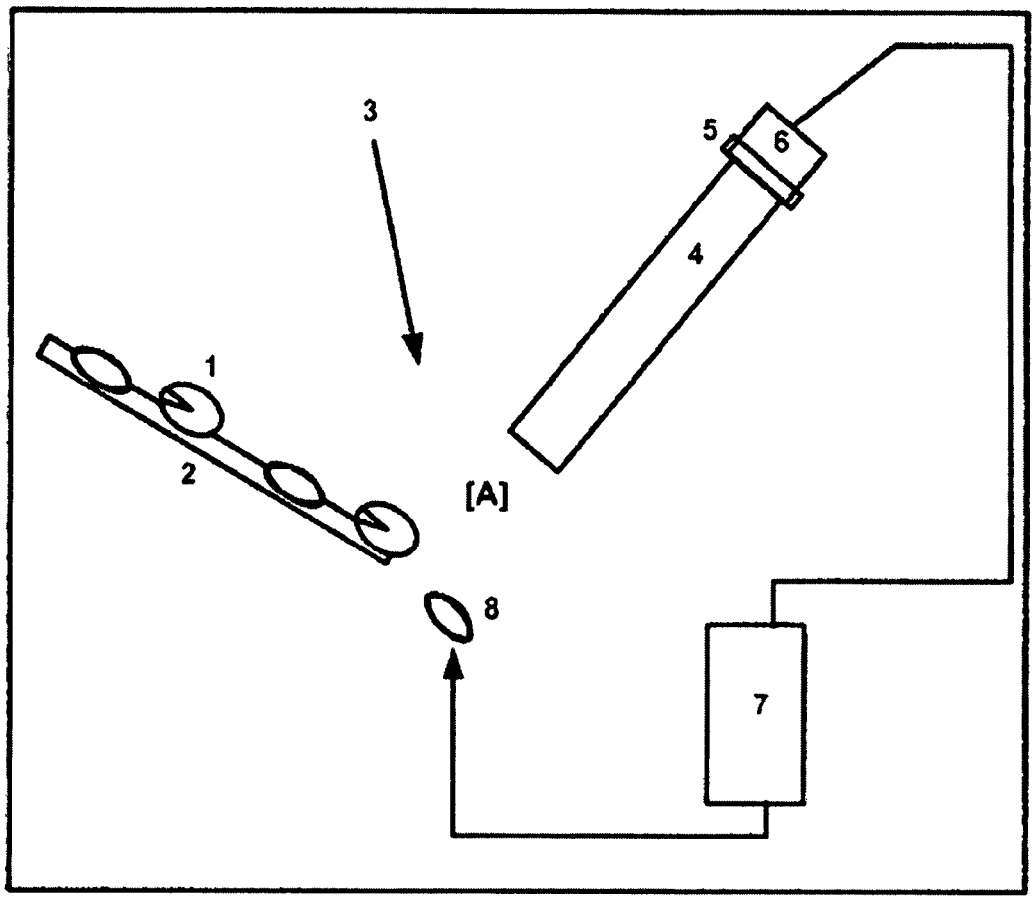
FIG. 1 (A) An exemplary apparatus for sorting using one light wavelength. A product to be sorted 1, travels in single file along a product feeding means 2. At the end of the product feeding means 2, the product to be sorted 1, is delivered to a sensing area [A] where it is illuminated by a light source 3. Light reflected from the illuminated product travels up a light conducting means 4, where it is incident on an optical bandpass filter 5. The optical bandpass filter transmits light in a select band of wavelengths centered at a desired wavelength. The light transmitted by the optical bandpass filter is incident on a photodiode 6. Typically, the wavelengths of light transmitted by the optical bandpass filter correspond to the wavelengths of light to which the photodiode is most sensitive. Thus, the optical bandpass filter and photodiode form a matched set, i.e., an optical banpass filter photodiode combination. A signal created by the photodiode in response to incident light is input to a decision circuit 7, which drives a diversion means 8. (B) An exemplary apparatus for sorting using two light wavelengths. As above, a product to be sorted 1, travels in single file along a product feeding means 2. At the end of the product feeding means 2, the product to be sorted 1, is delivered to a sensing area [A] where it is illuminated by a light source 3. A device for sorting at two wavelengths typically comprises, as shown, two light conducting means 4, two optical band pass filters 5, and two photodiodes 6, wherein the optical bandpass filters and photodiodes are matched to provide optical bandpass filter photodiode combinations that are sensitive to the wavelengths of light selected for sorting. Signals generated by the photodiodes in response to incident light are input to a decision circuit 7, which drives a diversion means 8.

Unless otherwise noted, technical terms are used according to conventional usage. Definitions of common terms in electronics and telecommunications sciences may be found in e.g., Federal Standard 1037C, *Glossary of Telecommunication Terms,* 1996, which is incorporated herein by reference.

The expression "population to be sorted" as used herein refers to a population of objects e.g. a population of agricultural products, the composition of which is heterogeneous. A "heterogeneous" population typically comprises more than one type or category of object. In an exemplary embodiment, a "population to be sorted" is a heterogeneous population from which it is desired that one object type or category comprising the heterogeneous population be selected out so as to create at least one other, second, population that is homogeneous. Thus, a heterogeneous population to be sorted is sorted into at least a first class and a second class.

The term "homogeneous population" or the term "homogeneous" as used herein typically refers to a population wherein at least about 80% of the objects comprising the population are of the same type or same category or same classification. In some exemplary embodiments a population is "homogeneous" when at least about 85% of the objects comprising the population are of the same type or same category or same classification. In other exemplary embodiments, a population is "homogeneous" when at least about 86%, 87%, 88%, or 89% of the objects comprising the population are of the same type or same category or same classification. In still other exemplary embodiments, a population is "homogeneous" when at least about 90%, 91%, 92%, 93%, 94%, 95%, 96%, 97%, 98%, 99%, or 100% of the objects comprising the population are of the same type or same category or same classification.

The term "agricultural process stream" as used herein refers to a flow or succession of agricultural objects. Typically, objects comprising an "agricultural process stream" move or proceed continuously past a fixed point such that they can be detected and separated into different categories. In one exemplary embodiment, an "agricultural process stream" comprises "tree nuts" e.g., pistachio nuts, almonds, Brazil nuts, pine nuts, chestnuts, walnuts, pecans, etc. In another exemplary embodiment, an "agricultural process stream" is a "kernel stream". The term "kernel stream" as used herein, refers to a flow or succession of a population of tree nuts comprised primarily of nut meats i.e., nuts without shells. In some exemplary embodiments, a "kernel stream" comprises a population of pistachio nuts that is comprised primarily of kernels (i.e., nuts without shells), but also comprises some percentage of in-shell nuts.

The term "microprocessor," or "micro-processor" as used herein, refers broadly without limitation, to a computer system, a computer equivalent, or a processor which is designed to perform arithmetic and/or logic operations using logic circuitry that responds to and processes the basic instructions that drive a computer. Thus, the term "microprocessor" refers to any device comprising a programmable digital electronic component that incorporates the functions of a central processing unit (CPU) on a single semiconducting integrated circuit (IC). Typical computer systems may comprise one or more microprocessors. Therefore, the term "microprocessor" as used herein, typically refers to a device comprising at least one microprocessor.

The term "optical bandpass filter" as used herein has the customary meaning as known in the art. Typically, an optical bandpass filter is operative for filtering light such that only a fraction of all possible wavelengths of light e.g., only desired wavelengths of light from a light source, pass through the optical bandpass filter to reach a detector on the opposite side of the bandpass filter from the light source. Thus, an optical bandpass filter is selected to have a passband centered at a desired wavelength of light. When an optical bandpass filter is selected to have a passband centered at a desired wavelength, it is said that the bandpass filter sorts at the desired wavelength. In an exemplary embodiment, an "optical bandpass filter" has a passband centered at 670 nm and thus transmits light in a band of wavelengths centered at 670 nm. The optical bandpass filter is thus said to be selected for sorting at 670 nm.

Typically an "optical bandpass filter" is coupled to a photodetector e.g., a photodiode, such that the wavelengths of light that are transmitted by the "optical bandpass filter" are of a wavelength or in a range of wavelengths to which the photodetector, e.g., photodiode, is most sensitive. Thus, the expression "optical bandpass filter photodiode combination", refers to an optical bandpass filter photodiode pair that are matched such that the bandpass filter transmits those wavelengths which are in a range of light wavelengths to which the photodiode is most sensitive. Thus, an "optical bandpass filter photodiode combination" permits the transmission and detection of light within a particular, selected range of the wavelength spectrum, while the rest of the spectrum is blocked.

The term "electronic circuit" as used herein, refers to an assembly of electronic circuitry components which function together receive information output from an "optical bandpass filter photodiode combination" and to process that information to achieve a particular result e.g., sorting a population comprising an agricultural process stream into at least a first class and a second class. As used herein, an "electronic circuit" typically comprises an interconnection of electrical elements such as e.g, resistors, current sources, switches, etc, but does not comprise a microprocessor, nor any elements which comprise a microprocessor. Thus, as used herein, an "electronic circuit" is "an electronic circuit that does not require microprocessor to evaluate signals and make decisions".

The term "product feeding means" as used herein, refers to a structure, e.g., a vibrating hopper, alone or in combination with a slide, a slide, a rotating drum etc., for singly delivering individual objects comprising "a population of objects to be sorted" to a region of space referred to herein as a "sensing area". At the "sensing area" light from a light source is incident on and then reflected from the object to be sorted. Typically, the "product feeding means" delivers the product or object singly or individually to the sensing area where the singulated object is detected and subject to action by a diversion means. Therefore, the "product feeding means "singulates" the population of objects to be sorted. Thus, in one exemplary embodiment, the product feeding means delivers objects comprising a population to be sorted to the "sensing area" in single file.

The term "light source" as used herein refers to any source of light that is sufficient to illuminate an object comprising a population to be sorted. Some exemplary light sources include, but are not limited to, an incandescent light bulb, a flourecent light bulb, a halogen lamp, a light emitting diode (LED), a neon lamp, a laser etc. . . . Thus, a "light source" as used herein refers to an illumination means sufficient to illuminate an object comprising a population to be sorted. Typically, light is reflected from an illuminated object type at a particular/desired wavelength which is correlated to the identity of the of the object type. The reflected light is captured at the input end of a "light conducting means" and at the output end of the light conducting means, is incident on an optical bandpass filter which is part of an "optical bandpass filter-photodiode combination". The photodiode converts the light incident thereon to an electrical signal that is related to the particular/desired wavelength which in turn is related to the identity of the illuminated object.

The term "light conducting means" as used herein refers to a structure, typically a hollow structure, which can be of any shape, e.g., circular, square, triangular, etc, which has an input end and an output end, that provides for transmission of light from a designated source to a light detector, while blocking or otherwise preventing or minimizing the transmission of light from sources other than the designated source e.g., blocking or excluding ambient light, sunlight, etc. Typically, light from a designated source enters at the at the input end of the "light conducting means" and travels toward the output end of the "light conducting means" where an optical bandpass filter transmits light a passband of light wavelengths centered at a desired wavelength to a photodiode. In one exemplary embodiment, a "light conducting means" is a tube with a circular structure. In another exemplary embodiment, a "light conducting means" transmits the light reflected from the surface of an illuminated object to a detector while at the same time excluding ambient light and preventing transmission and/or incidence of the ambient light on the detector.

The term "diversion means" as used herein refers to a structure or the resultant physical action caused by a structure, that provides means for removing select objects from a population. Diversion means can be any suitable means for achieving the desired result e.g., diverting one class of objects from a population of objects to be sorted. Exemplary diversion means include, but are not limited to e.g., a blast of compressed air from an air nozzle, a mechanical arm or lever, a water jet, an air powered actuator, a hydraulic powered actuator, and etc.

I. Introduction:

Microprocessor based sorting equipment is typically used in modern processing plants to remove contaminants and/or defects from agricultural commodities. The sorting equipment is sophisticated, and unfortunately, expensive. Often, the degree of sophistication embodied by micro-processor based sorting machines is unnecessary for the task at hand. To make matters worse, despite the sophistication and expense of computer based sorting machines, machine sorted commodities typically require a further manual inspection and sorting step to produce a quality finished product. Thus, producers of agricultural commodities are faced with high production costs for their product, and these production costs are passed on to consumers.

Since many consumers are budget-conscious, sales of commodities suffer when prices are high. Therefore, it would greatly benefit both producers and consumers of agricultural commodities to have available and in use, inexpensive sorting machines that provide low cost sorted product that is of equal or better quality than that afforded by the expensive, sophisticated, microprocessor based sorting machines.

Fortunately, the present inventors have created such a device. Indeed, disclosed herein is a sorting apparatus, and several variations thereon, which effectively sorts objects comprising a population to be sorted, that is inexpensive, and versatile, and which does not comprise a microprocessor, nor any microprocessor based components. The apparatus sorts objects comprising a population to be sorted by exploiting differences in light reflectivity between the different types and/or categories of objects comprising the population. All types of objects can be sorted provided that the light reflected from the different objects comprising the population is different.

The apparatus sorts objects rapidly and efficiently by means of a simple electronic circuit, without the need for a microprocessor. Indeed, the apparatus sorts at equal speed and with comparable accuracy to commercially available microprocessor based dual band NIR/visible light sorters.

II. Apparatus for Sorting Objects Comprising a Population to be Sorted

A. Apparatus for Sorting Objects Using a Single Wavelength of Light

In one aspect, the invention provides an apparatus for sorting objects comprising a population into one of at least a first class and a second class using a single wavelength of light to sort the objects e.g., using a bandpass filter selected to have a passband centered at a single desired wavelength of light. In an exemplary embodiment, the population of objects to be sorted is a population comprising pistachio nuts. In another exemplary embodiment, the population of objects to be sorted comprises in-shell pistachio nuts and pistachio kernels.

An exemplary apparatus is shown schematically in FIG. 1A. Objects comprising a population of objects to be sorted e.g., a population of pistachio nuts comprising both in shell nuts and kernels 1, travel along a product feeding means e.g., a slide, conveyor belt, etc, 2 in single file. Individual objects exit the product feeding means and enter a sensing area [A] where they pass a light source 3. In the sensing area [A], the individual object is illuminated by a light source 3. Reflected light from the object travels up the light conducting means 4, through a band pass filter 5 which transmits light in a select passband e.g., passband centered at a desired wavelength, e.g., at a wavelength of 670 nm. Light transmitted through the optical bandpass filter is incident on a photodiode 6. Typically, the photodiode is selected to correspond in sensitivity to the passband of the optical bandpass filter. Thus, the optical passband filter and photodiode form an optical passband-photodiode combination. The photodiode converts the incident light into an electric signal which in turn, serves as an output signal from the photodiode. The output signal from the photodiode 6 is then input at a decision circuit 7, which in turn drives a diversion means 8.

B. Apparatus for Sorting Objects Using Multiple Wavelengths of Light

In another aspect, the invention provides an apparatus for sorting objects comprising a population into one of at least a first class and a second class using multiple wavelengths of light to sort the objects.

Figure 1B:
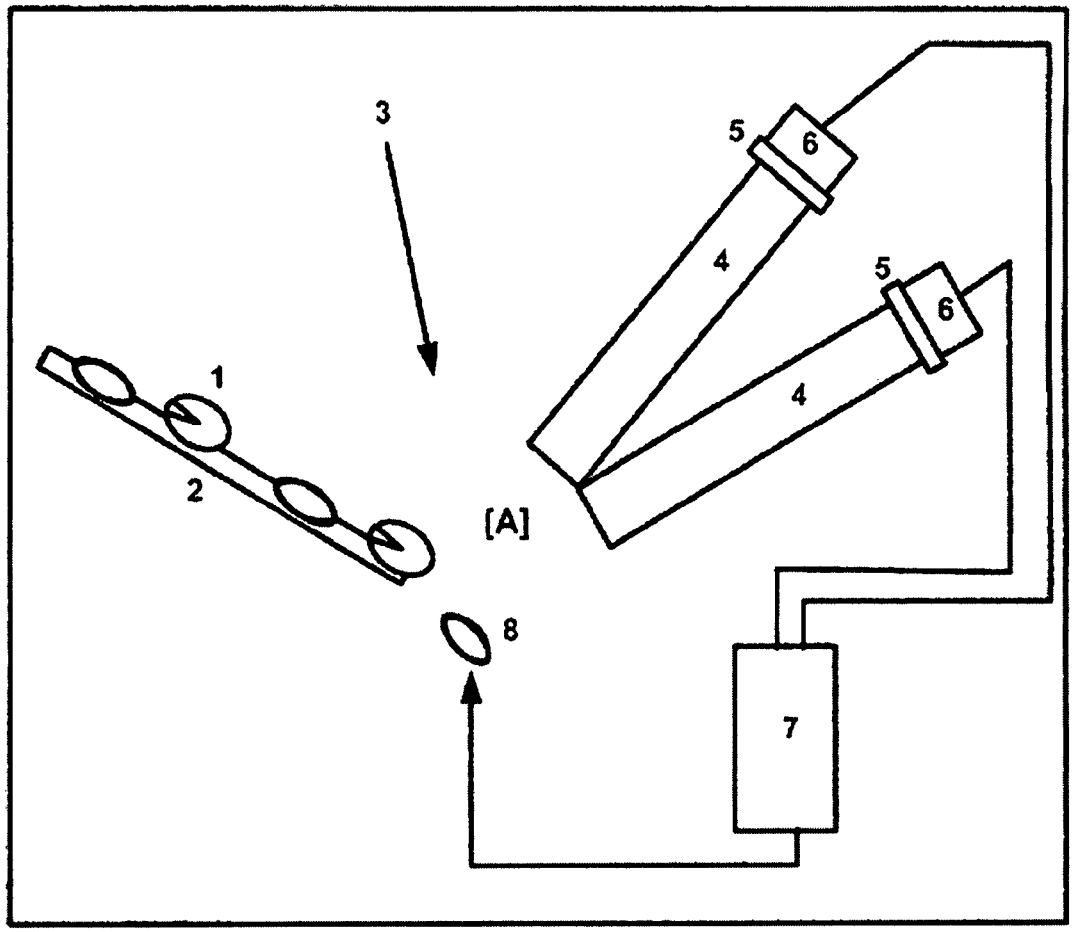

FIG. 1B illustrates an exemplary device for sorting based on reflectivity from the sample surface at two different light wavelengths. As in the device illustrated in FIG. 1A, objects 1 to be sorted travel along a product feeding means 2. Individual objects singly exit the product feeding means and enter a sensing area [A] where they pass a light source 3. In the sensing area [A], the individual object is illuminated by the light source 3. Reflected light from the object travels up each of two different light conducting means 4, through two different optical band pass filters 5, and is incident on the two different, photodiodes 6 which are matched to their corresponding optical bandpass filters, and which thus form two optical bandpass filter-photodiode combinations. Output signals from the photodiodes 6 are input at a decision circuit 7, which applies a predetermined decision function and drives a diversion means 8.

C. Decision Circuit

Typically, a decision circuit comprises at least a signal conditioning means, a comparing means, a switching means, and a diversion means. In those exemplary embodiments wherein more than one wavelength of light is used to sort objects comprising a population to be sorted, a decision circuit further comprises an either a summing amplifier, or a difference amplifier. The choice of summing or difference amplifier is readily made by persons skilled in the art, depending on the particular scheme used for sorting objects comprising the population. In some exemplary embodiments the amplifier is a summing amplifier, and in other exemplary embodiments, the amplifier is a difference amplifier.

1. Signal Conditioning and Comparing Means

FIG. 2 A shows an exemplary decision circuit for sorting objects using a single wavelength of light. Output from photodiodes of the sorting apparatus 6, are input to a photovoltaic amplifier 9 which converts the photodiode current to a voltage for processing. The photovoltaic amplifier 9, is the first of a series of components which together comprise the "signal conditioning means" of the decision circuitry. In addition to the photovoltaic amplifier 9, signal conditioning means further comprises an inverting amplifier 10, and a variable resistor 11. The inverting amplifier 10, and a variable resistor 11 together comprise a first-order low-pass filter which attenuates high frequency noise, provides offset adjustment for the output, and adds additional gain. Typically, the variable resistor 11 is placed on the input of the low-pass filter to allow for adjustment of the gain to appropriate levels for input to the comparing means. As is known by those of skill in the art, an appropriate gain is one that provides a signal for the subsequent circuit stages that is significantly larger than the background noise, but not so large as to saturate the electronics.

Figure 2A:
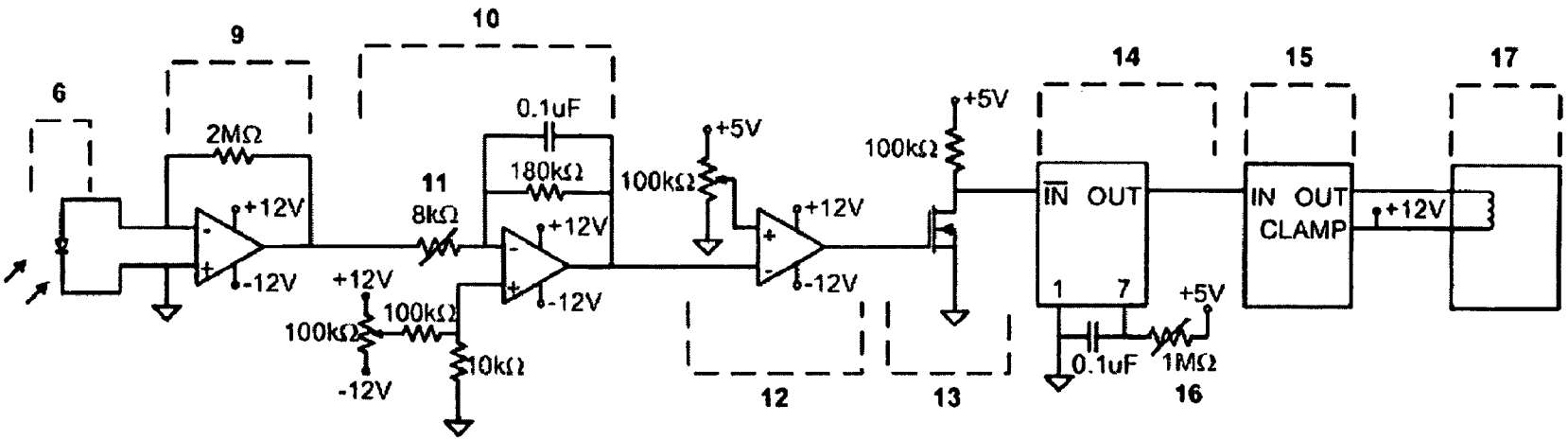
FIG. 2 (A) Exemplary electronic circuit for single wavelength sorting comprising: signal conditioning for amplification of the photodiode signal, attenuation of power line and higher frequency noise, and offset adjustment; decision circuitry in which input signals are compared to a threshold level; and switching circuitry to drive the diversion means. B. Exemplary electronic circuit for dual wavelength sorting, including: signal conditioning for adjustable amplification of the photodiode signal to implement coefficients of the decision function, attenuation of power line and higher frequency noise, and offset adjustment; a summing (or difference) means to combine coefficients of the decision function; decision circuitry in which it is determined if the decision function is true; and switching circuitry to drive the diversion means.

Still referring to FIG. 2A, the circuit comprises a comparing means, which provides a mechanism for comparing the signal output from the signal conditioning means to a threshold value. In an exemplary embodiment, the comparing means comprises a comparator 12. However, any means known for comparing a voltage signal to a threshold value may be used. Thus, in another exemplary embodiment, the decision making means comprises an operational amplifier (op-amp) designed to compare two signals. Operational amplifiers are well known in the art (see e.g., Tobey, G. E., et al. *Operational Amplifiers-Design and Applications*, McGraw Hill (1971)). In another exemplary embodiment, a Schmitt trigger is used, utilizing either an operational amplifier or transistors.

The comparator 12, or other suitable comparing means, compares the incoming signal from the signal conditioning means to a pre-set threshold voltage. If the threshold is exceeded, the comparator outputs a logic level high signal to the switching means.

Since the comparator input is variable, the threshold can be adjusted to accommodate any desired sorting priority, e.g., allowing one stream or the other to be 100% accurate or to divide any error between the two streams. Threshold values corresponding to particular error rates can be determined by methods known in the art e.g., from a training set made up of desired classes to be separated. See e.g., Haff and Pearson, supra.

2. Switching Means and Diversion Means

Referring again to FIG. 2A, the switching means comprises a MOSFET switch 13, a one-shot timer 14, a driver 15, and a variable resistor 16.

In an exemplary embodiment, the logic level signal from the comparator 12 triggers an n-channel MOSFET 13, which creates an appropriate signal for a one-shot timer 14. The timer is easily adjusted with a variable resistor 16 to change the duration of its output (e.g., air burst duration). The one shot timer 14 signals a driver 15, which supplies appropriate power to the diversion means 17. The diversion means 17 may comprise any suitable apparatus for sorting objects, e.g, for diverting objects from an agricultural process stream or other population to be sorted. In one exemplary embodiment, the diversion means comprises a solenoid-based air valve. Thus, in one exemplary embodiment, the diversion means removes objects from a population to be sorted by triggering an air burst, such that the air burst redirects the travel path of the selected object. In another exemplary embodiment, the diversion means comprises any mechanical mechanism that redirects objects based on an input signal from the decision circuitry.

3. Variations of the Decision Circuitry to Accommodate Sorting at More than One Wavelength of Light In order to make use of two voltage outputs for the decision making process, a simple threshold comparison does not suffice. A common technique, well known in the art, is to generate a predetermined decision function of the form Ax+By>K (?), where A and B are constant coefficients for the variables x and y respectively, and K is a constant. In an exemplary embodiment, x and y are the voltage inputs from the two photodiodes and hence represent the reflectivity from the surface of the sample at two distinct wavelengths. The equation is evaluated through the use of an electronic circuit, eliminating the need for a micro-processor. For a particular sample, whether or not the equation is true determines whether or not the diversion means is activated.

To make use of more than two voltage outputs for the decision making process the equation is extended to n wavelengths wherein the apparatus incorporates n light conducting means, n filter/photodiode combinations, and the decision circuit would include n branches for computing an equation of the form $$A_1x_1+A_2x_2+\ldots+A_nx_n>K \quad (?)$$

a. Decision Circuitry

Figure 2B:
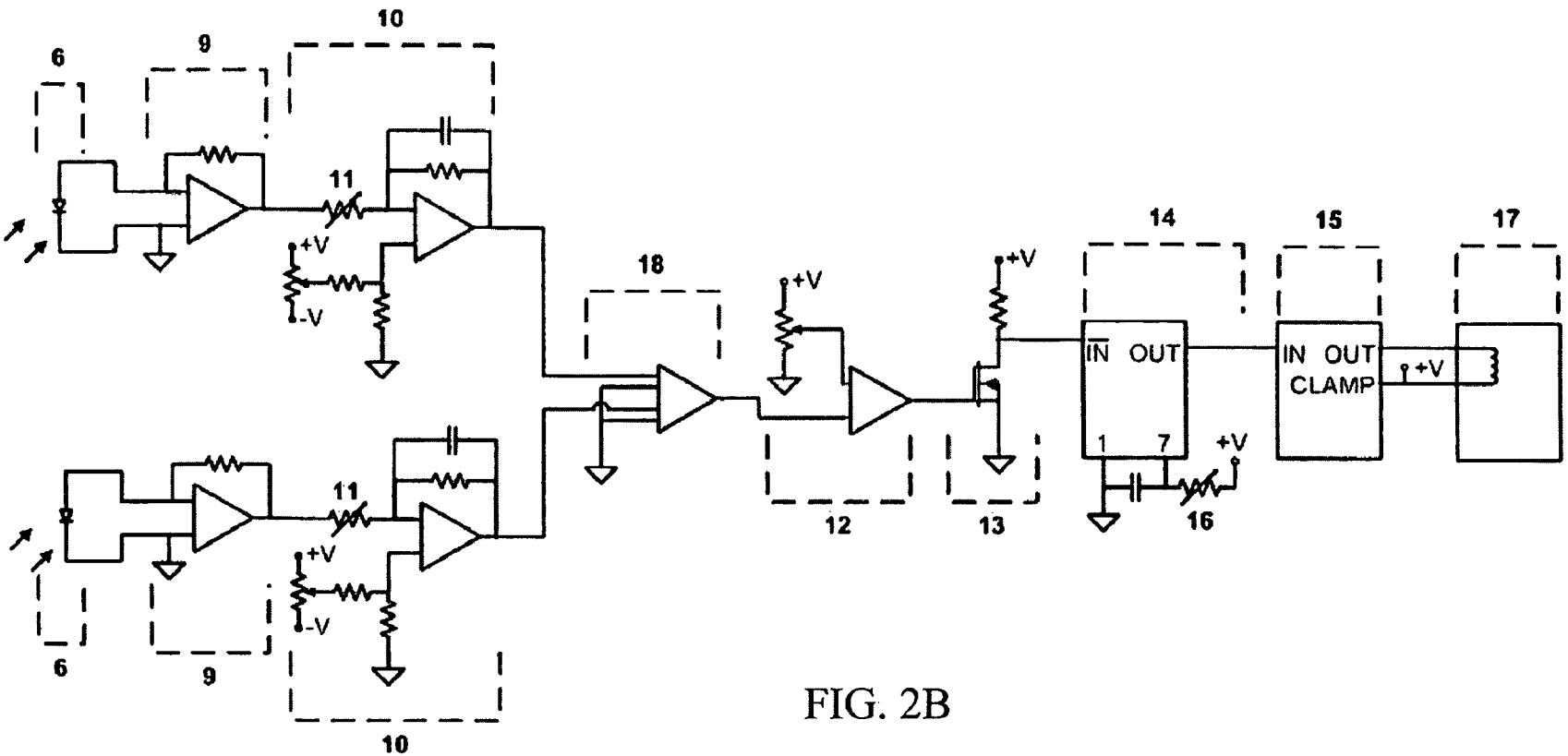

An exemplary circuit for sorting at two different wavelengths is illustrated in FIG. 2B. Two photodiodes and signal conditioning means (comprising photovoltaic amplifier 9, and low pass filter comprising an inverting amplifier 10 and a variable resistor 11) allow for sorting based on the voltage outputs from the photodiodes. The low pass filters serve as multipliers, wherein the amount of amplification is proportional to the value of the variable resistor. The two resulting signals are summed (or the difference taken) by a summing (or difference) amplifier 18, and the output is compared to the constant (K) from the decision equation, thus implementing the decision equation, or decision function.

b. Switching Means and Diversion Means

The switching means and diversion means for multiple wavelength sorting follow the discussion for the single wavelength sorter described above, as the nature of the signal from the decision circuit does not change.

III. Determining the Appropriate Wavelength(s) of Light for Sorting Objects Comprising a Population to be Sorted According to one aspect of the invention, object types comprising a population to be sorted are differentiated by differences in reflectivity of each object type at a given wavelength of light. To facilitate the sorting of objects types comprising a population of objects to be sorted, one typically measures the reflectivity of each object type to be sorted across a selected light spectrum, e.g., across the visible light spectrum. Thus, one determines whether one (or more) object type(s) to be sorted reflect more or less light than other objects types comprising the populations at different wavelengths of light. If so, the difference in reflectivity can be exploited to sort one or more different object types comprising the population.

Selection of optimal wavelengths for sorting objects, either for visible light or NM sorting, is an area of active research (see e.g., Haff, R. P., and Pearson, T. C. (2006) Transactions of the ASABE. 49(4): 1105-1113). Any convenient method may be used to determine an appropriate wavelength for sorting. Some exemplary techniques for determining an appropriate wavelength(s) include, but are not limited to e.g., the use of a graph of spectrophotometer data to determine the wavelength of greatest difference in reflectivity between classes, and the use of statistical methods e.g., discriminant analysis or principle component analysis, to determine multiple optimal wavelengths and decision functions for separation of classes. Such techniques are well known in the art (see e.g., McLachlan, G. J. (1992) "Discriminant analysis and statistical pattern recognition", John Wiley and Sons, New York).

Once an appropriate wavelength or wavelengths or sorting have been selected, the choice is applied for real-time sorting. Once an appropriate wavelength or wavelengths is/are is selected for sorting the decision function is applied through an electronic circuit without the aid of a microprocessor. In exemplary embodiments, this approach provides higher speed, and higher reliability sorting at a lower cost that can be achieved with microprocessor based devices.

Figure 3:
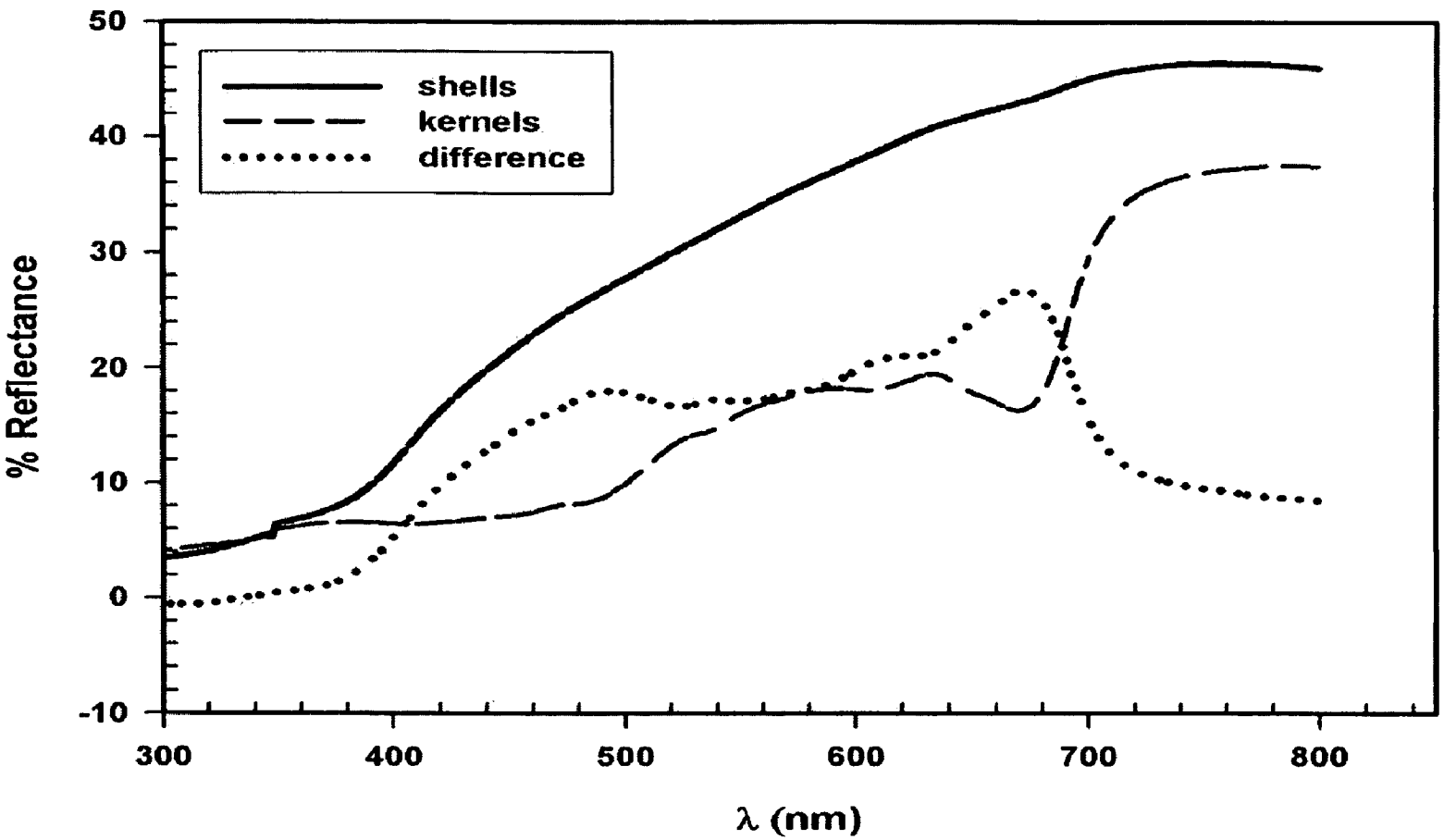
FIG. 3. An exemplary difference spectrum. The figure illustrates a difference spectrum between pistachio kernels and shells when reflectance is measured over the visible portion of the electromagnetic light spectrum.

In an exemplary embodiment, a spectrophotometer is configured to measure a particular range of light frequencies, e.g., the entire visible spectrum. Object types to be sorted are identified as members of a population, and then reflected light from each object type is measured over the chosen spectrum. The average spectra for the various object types are graphed together to show any distinction between them. An exemplary difference plot wherein percent reflectivity is plotted vs. wavelength, is shown in FIG. 3. Although any convenient wavelength may be chosen for sorting, in one exemplary embodiment, the wavelength of light chosen for sorting is the wavelength of light at which the difference in reflectivity between object types is the greatest.

An appropriate wavelength for sorting can be seen visually from a difference plot as illustrated in FIG. 3. In some exemplary embodiments, the actual difference in reflectivity is plotted along with the reflectance spectra of the different object types to be sorted, thereby facilitating a visual approach to analysis of the difference spectra see e.g., FIG. 3.

Using the difference spectra, a light wavelength(s) which provides good separation of the object types comprising the population to be sorted, is chosen. An optical bandpass filter with a passband centered at the desired wavelength is then selected which will transmit light of the desired wavelengths to the photodiode, and will, at the same time, block undesired wavelengths from reaching the photodiode. In some exemplary embodiments, the apparatus is configured to sort objects at more than one wavelength of light by adding to the apparatus more than one light conducting means, and supplying at the output end of the light conducting means an appropriate optical bandpass filter-photodiode combination, and decision circuitry as disclosed above.

IV. Methods for Sorting Object Types Comprising a Population to be Sorted

In an exemplary embodiment, the invention provides methods for sorting object types comprising a population to be sorted into one of at least a first class and a second class which utilize the apparatuses disclosed herein.

In one embodiment the sorting method comprises: (1) determining a percent reflectance from each object type comprising the population to be sorted at light wavelengths across a spectrum of light wavelengths. In one exemplary embodiment, the spectrum of light wavelengths comprises light wavelengths from about 400 nm to about 1700 nm. In another exemplary embodiment, the spectrum of light wavelengths comprises light wavelengths from the visible region of the electromagnetic spectrum. In another exemplary embodiment, the spectrum of light wavelengths comprises light wavelengths from the red region of the visible region of the electromagnetic spectrum.

In an exemplary embodiment, percent reflectance is measured using a spectrophotometer, however any convenient means for measuring reflectance may be used e.g., by using an LED to measure the reflection of light from the surface of the object types comprising the population to be sorted. In one exemplary embodiment, the light wavelengths are measured across the spectrum of light wavelengths from about 400 nm to about 1700 nm.

Once reflectance data are generated, in an exemplary embodiment, the averages are plotted on the same graph such that the difference in percent reflectance between each object type comprising the population to be sorted can be calculated/determined. In some exemplary embodiments, the difference in average reflectivity between the classes of object types is also plotted at each wavelength measured.

Once percent reflectance has been determined for the different object types comprising the population to be sorted, a light wavelength is selected for sorting. Typically, sorting wavelengths are chosen such that the voltage generated by the photodiode detector for at least one object type comprising the population is sufficiently different from the voltage generated from the other object types comprising the population to be sorted, that the at least one object type can be sorted out of the population with the desired degree of accuracy. In an exemplary embodiment, a light wavelength wherein the difference in percent reflectance between the at least one object type comprising the population to be sorted is greatest, is chosen as the desired wavelength for sorting.

A threshold value for activation of the diversion means is then determined by observing the voltage produced by the light reflected from the at least one object type at the desired wavelength compared to the other object type(s) comprising the population. In an exemplary embodiment, an oscilloscope is used to display a continuous graph of voltage vs. time as object types pass through the sensing area of the sorting apparatus, and a voltage is chosen wherein the voltage generated by the at least one object type shows the least amount of overlap with other object types comprising the population of objects to be sorted. In an exemplary embodiment, that voltage, which shows the least overlap, is chosen as the voltage that triggers the diversion means.

The population to be sorted is then loaded onto an apparatus for sorting objects. In one exemplary embodiment, the apparatus comprises (i) a product feeding means, (ii) a light source, (iii) a sensing area, (iv) a light conducting means, (v) an optical bandpass filter centered at the desired wavelength and a photodiode which form an optical bandpass filter-photodiode combination centered at the desired wavelength, (vi) a decision circuit, and (vii) a diversion means. Wherein the optical bandpass filter transmits light to the photodiode in a band of wavelengths centered at the desired wavelength, and wherein the photodiode converts the light transmitted through the optical bandpass filter to an electric current, thereby generating a signal related to the desired wavelength that is input to the decision circuit, and wherein the decision circuit is an electronic circuit that does not require a microprocessor to evaluate signals and make decisions, (5) setting a threshold value for activation of the diversion means by the decision circuit, and (6) activating the apparatus for sorting objects, thereby sorting object types comprising a population to be sorted into one of at least a first class and a second class.

In another exemplary embodiment, a population to be sorted is loaded onto an apparatus for sorting objects that comprises (i) a product feeding means, (ii) a light source, (iii) a sensing area, (iv) at least a first and at least a second light conducting means, (v) at least a first optical bandpass filter and a first photodiode which form a first optical bandpass filter-photodiode combination and at least a second optical bandpass filter and a second photodiode which form a second optical bandpass filter-photodiode combination, (vi) a decision circuit, and (vii) a diversion means, and the at least first optical bandpass filter transmits light to the at least first photodiode in a band of wavelengths centered at a first desired wavelength, and the at least second optical bandpass filter transmits light to the at least second photodiode in a band of wavelengths centered at a second desired wavelength, and the at least first photodiode converts the light transmitted through the first optical bandpass filter to an electric current, thereby generating a signal related to the first desired wavelength that is input to the decision circuit, and the at least second photodiode converts the light transmitted through the at least second optical bandpass filter to an electric current, thereby generating a signal related to the second desired wavelength that is input to the decision circuit, which is an electronic circuit that does not require a microprocessor to evaluate signals and make decisions.

In this embodiment, light wavelengths are chosen as disclosed above, and the voltage threshold is chosen as disclosed in section II.C.3., and II.C.3a above, for sorting using more than one light wavelength.

The following examples are offered to illustrate, but not to limit the invention.

EXAMPLES

Example 1

The following example illustrates a method of separating pistachio kernels from shells and in-shell nuts, and the building of a fast and non-destructive sorting apparatus.

The apparatus comprises a product feeding means, a light source, a light guiding means, a band pass filter, a photodiode, a decision circuit, and a diversion means. The apparatus makes sorting decisions without the aid of a micro-processor. An exemplary apparatus is shown schematically in FIG. 1A. A photodiode converts light into an electric current. The produced current is proportional to the amount of light detected; thus, the photodiode functions as a light sensor. The decision circuit compares the output signal from the photodiode to a predetermined threshold and generates a signal (or not) depending on the results of the comparison.

To determine the appropriate wavelength for sorting, the amount of light reflected from samples at every wavelength between 300 nm and 800 nm was measured using a spectrophotometer. Spectra from 23 kernels and 23 in-shell nuts were generated, and the averages plotted on the same graph (FIG. 3). Also plotted was the difference in average reflectivity between the two classes at each wavelength.

As shown in FIG. 3, the highest point in the difference plot occurs near 670 nm, which is in the red portion of the visible spectrum. A readily available 675 nm band-pass filter was therefore selected to mount over the photodiode.

The sorting apparatus comprised a vibrating hopper, a v-shaped slide, a flexible fiber optic light source, a PVC tube for conducting the reflected light while blocking (most) ambient light, the 675 nm band pass filter mounted over a photodiode, an electronic circuit, an air compressor, and an air nozzle. (See e.g., FIG. 1A). Samples were poured into the vibrating hopper, which delivered them single file to the slide. The slide served to create an appropriate spacing between samples. Thus, samples came into the field of view of the photodiode in single file without bunching together. The light guiding tube was aligned with the bottom of the slide so that reflected light could be captured immediately after the sample exited the slide. The band pass filter/photodiode combination was mounted at the end of the tube opposite the light source. Reflected light at 675 nm was thus incident on the photodiode and the resulting output signal conducted to the decision circuit. The circuit compared the photodiode signal to a predetermined threshold and triggered an air nozzle if an in-shell sample was detected, and the resulting air blast diverted the sample to the desired bin Finding the Voltage Threshold Using an oscilloscope, voltage output from the decision circuit was monitored as samples were processed through the sorting apparatus. Data was collected from 238 kernels, 286 in-shells and 236 shells. For each sample, the maximum voltage output from the photodiode was recorded, entered into an Excel worksheet, and arranged in increasing order. The data showed the least amount of overlap between kernels and in-shells near 1340 millivolts, with only 7 in-shells and kernels overlapping out of 534 samples.

Results

Results for separating kernels from shells and in-shell nuts with the photodiode-based apparatus are shown in Table 1. The percent correctly classified for kernels, in-shell nuts, and shells were 100% correct for in-shell nuts, 95% correct for shells, and 92% correct for kernels (table 1).

TABLE 1

Classification results using photodiode system.

| | % Correct | Number of samples |
|---|---|---|
| In-shells | 100% | 337 |
| Shells | 95% | 200 |
| Kernels | 92% | 200 |

Example 2

The following example illustrates the testing of an exemplary low cost sorting apparatus as disclosed herein against the performance of a typical commercially available sorter in terms of speed and accuracy for separating in-shell pistachios from kernels.

Incident visible light (300 nm to 800 nm) reflected from fifty samples of each of in-shell pistachio nuts and kernels was measured using a spectrophotometer. Spectra were averaged, and the difference plotted to determine the wavelength of maximum difference. A photodiode was mounted behind an appropriate band pass filter so that the reflection of light from the samples at the frequency of interest could be measured.

A schematic representation of the sorting apparatus used in these experiments is shown in FIG. 1A. Samples were loaded into a magnetic feeder which delivered them to a slide in single file. The slide was constructed from a 51 cm (20 inch) length of aluminum with a v-shaped cross section with a Teflon insert, allowing the samples to slide without tumbling. A twin source fiber optic light with flexible arms illuminated the sample as it exited the slide. Some of the reflected light was transmitted through a light guiding tube, which was constructed using a 15.25 CM (6 inch) length of threaded PVC pipe with 1.9 cm (0.75 inch) diameter. The light tube was designed to prevent ambient light from external sources reaching the detector. Reflected light from the sample was thus incident on the detector, which comprises the filter/photodiode pair as described above. The voltage output from the photodiode was analyzed by an electronic circuit. The circuit classified the sample as either in-shell or kernel and transmitted a signal to activate an air nozzle if the sample was to be diverted. An exemplary circuit is shown in FIG. 2A.

For testing of the device, the comparator level was set to minimize error for the in-shell stream, and one thousand each of in-shells and kernel samples were testing, and the results compared to the results reported for a commercially available dual-band NIR-VIS sorting device (Haff, R. P., and T. Pearson (2006) *Trans. ASABE* 49(4): 1105-1113). Additionally, one thousand half shells were tested and results compared as described for the in-shell samples.

FIG. 3 shows the result of averaging the spectra from the spectrophotometer of the in-shell samples and the kernel samples in this study. Also shown is the difference between the two streams. Note that the peak of the difference curve occurs around 670 nm, so a band pass filter with a FWHM of 10 nm centered at 675 nm was selected.

Table 2 compares results of sorting 1000 each of shell halves, in-shell nuts, and kernels using both a commercially available dual-wavelength NIR-VIS sorter as reported by Haff and Pearson (2006) and the low cost single wavelength sorter.

TABLE 2

Results of sorting 1000 each of shell halves, in-shell nuts, and kernels.

| | Commercial sorter % correctly classified | New sorter % correctly classified |
|---|---|---|
| In-shell | 98.3 | 95.0 |
| Shell halves | 97.6 | 95.0 |
| Small inshell | 99.3 | 100.0 |
| Total | 1.6 | 3.3 |

The overall error rate for the commercially available sorter was 1.6% versus 3.3% for the low cost single wavelength sorter. However, considering the low material cost of this invention (<$500 US) vs. the cost of a new dual band NIR-VIS sorter (close to $100,000 US), it is believed that this invention might offer a more economical alternative.

An important consideration in the implementation of a real-time sorting device is the throughput, or the speed of sorting. Since the material handling for this invention is comparable to that used in commercially available devices, the design parameter influencing sorting speed is data acquisition and processing. Since the apparatus disclosed herein utilizes a simple electronic circuit for decision making, it actually has an equal or higher potential throughput than the more complicated devices, which use micro-processors for the decision making process.

It is understood that the examples and embodiments described herein are for illustrative purposes only and that various modifications or changes in light thereof will be suggested to persons skilled in the art and are to be included within the spirit and purview of this application and scope of the appended claims.

What is claimed is:

1. A method of sorting object types comprising a population to be sorted into one of at least a first class and a second class, the method comprising:

(1) determining a percent reflectance from each object type comprising the population to be sorted at light wavelengths across a spectrum of light wavelengths comprising wavelengths from about 400 nm to about 1700 nm, (2) calculating the difference in percent reflectance between each object type comprising the population to be sorted at light wavelengths across the spectrum of light wavelengths from about 400 nm to about 1700 nm, (3) selecting a light wavelength wherein the difference in percent reflectance between each object type comprising the population is greatest, thereby discovering a desired wavelength, (4) loading a population to be sorted which comprises the object types onto an apparatus for sorting objects, wherein the apparatus comprises:

(i) a product feeding means, (ii) a light source, (iii) a sensing area, (iv) a light conducting means, (v) an optical bandpass filter centered at the desired wavelength and a photodiode which form an optical bandpass filter-photodiode combination centered at the desired wavelength, (vi) a decision circuit, and (vii) a diversion means wherein the product feeding means delivers an object to be sorted to the sensing area where the object is illuminated by the light source, and wherein light is reflected from the illuminated object, and the reflected light enters the light conducting means at an input end and travels toward an output end of the light conducting means where it is incident on an optical bandpass filter selected to have a passband centered at the desired wavelength of light, and wherein the optical bandpass filter transmits light to the photodiode in a band of wavelengths centered at the desired wavelength, and wherein the photodiode converts the light transmitted through the optical bandpass filter to an electric current, thereby generating a signal related to the desired wavelength that is input to the decision circuit, and wherein the decision circuit is an electronic circuit that does not require a microprocessor to evaluate signals and make decisions, and wherein the decision circuit drives the diversion means, (5) setting a threshold value for activation of the diversion means by the decision circuit, and (6) activating the apparatus for sorting objects, thereby sorting object types comprising a population to be sorted into one of at least a first class and a second class.

2. The method of claim 1, wherein the population to be sorted comprises an agricultural process stream.

3. The method of claim 2, wherein the agricultural process stream comprises a population of tree nuts.

4. The method of claim 3, wherein the population of tree nuts is a population of pistachio nuts.

5. The method of claim 4, wherein the population of pistachio nuts comprises in-shell nuts and kernels.

6. The method of claim 5, wherein the desired wavelength is 670 nm.

7. The method of claim 1, wherein the product feeding means is a member selected from the group consisting of a slide, a conveyor belt, and a rotating drum, and wherein, the product feeding means delivers the objects comprising the population to a sensing area in single file.

8. The method of claim 1, wherein the decision circuit comprises: a signal conditioning means, a comparing means, and a switching means.

9. The method of claim 8, wherein the comparing means comprises a comparator.

10. The method of claim 1, wherein the diversion means is a member selected from the group consisting of an air burst from a solenoid-based air valve, a mechanical arm or lever, a water jet, an air powered actuator, and a hydraulic powered actuator.

* * * * *